US005785447A

United States Patent [19]

Fonti et al.

[11] Patent Number: 5,785,447

[45] **Date of Patent: *Jul. 28, 1998**

[54] CONNECTOR FOR STRUCTURAL APPARATUS

[75] Inventors: Michael A. Fonti, Springfield; Jack E. Gonzenbach, Nixa, both of Mo.

[73] Assignee: Miracle Recreation Equipment Co., Monett, Mo.

[ * ] Notice: The term of this patent shall not extend beyond the expiration date of Pat. No. 5,575,580.

[21] Appl. No.: 754,700

[22] Filed: Nov. 21, 1996

[51] Int. Cl.[6] ..... E04G 7/00

[52] U.S. Cl. ..... 403/49; 403/175; 403/230; 403/241; 403/396; 248/219.4; 248/230.1; 256/65; 256/67

[58] Field of Search ..... 403/49, 230, 241, 403/335, 336, 362, 175; 256/65, 67, 68; 248/219.4, 230.1

[56] References Cited

U.S. PATENT DOCUMENTS

| | | | |
|---|---|---|---|
| 539,249 | 5/1895 | Clamer | 403/362 X |
| 555,512 | 3/1896 | Johnson | 403/362 |
| 582,170 | 5/1897 | Brown . | |
| 1,344,342 | 6/1920 | Hanson . | |
| 1,547,214 | 7/1925 | Gooding | 403/362 X |
| 2,676,025 | 4/1954 | Davis . | |
| 2,850,311 | 9/1958 | Mansfield . | |
| 3,092,407 | 6/1963 | Blonder . | |
| 3,428,300 | 2/1969 | Sconzo . | |
| 3,524,627 | 8/1970 | Boyanton et al. . | |
| 4,619,545 | 10/1986 | Küttenbaum . | |
| 4,632,221 | 12/1986 | Stanford . | |
| 4,834,431 | 5/1989 | Calmettes et al. . | |
| 4,840,513 | 6/1989 | Hackett . | |
| 4,864,795 | 9/1989 | Burg | 403/175 X |
| 4,880,195 | 11/1989 | Lepley . | |
| 4,896,454 | 1/1990 | Cronenwett et al. . | |
| 4,915,535 | 4/1990 | Willetts . | |
| 5,098,051 | 3/1992 | Aldridge et al. . | |
| 5,184,911 | 2/1993 | Wu . | |
| 5,193,774 | 3/1993 | Rogers | 248/219.4 |
| 5,531,536 | 7/1996 | Blanchfield et al. | 403/340 |
| 5,575,580 | 11/1996 | Parrish et al. | 403/49 |

*Primary Examiner*—Daniel P. Stodola
*Assistant Examiner*—Bruce A. Lev
*Attorney, Agent, or Firm*—Polster, Lieder, Woodruff & Lucchesi, L.C.

[57] ABSTRACT

A connector for a structural apparatus. The connector includes a pair of oppositely disposed C-shaped connectors which are adapted to surround a post and are detachably connected to one another. The connectors include a first movable position allowing movement of the connectors relative to each other as well as to the post. In a second fixed position where the connectors are secured to the post. Each C-shaped connector has complementary interfitting end elements for assembling the pair of C-shaped connectors together to surround the post. The C-shaped connectors are secured to each other by complementary fastening elements that extend in the same direction as and cooperate with the complementary interfitting elements. The complementary interfitting elements or connections are provided on a transversely extending end surface at opposite ends of each C-shaped connector for assembling the C-shaped connectors to each other. The complementary fastening elements extend through adjacent end surfaces of the C-shaped connectors for securing the same to each other. Each C-shaped connector further includes an independent fastening element for securing each C-shaped connector to the post. A component receiver is mounted on one of the C-shaped connectors and is constructed to facilitate assembly to one C-shaped connector as well as to an elongated cylindrical bar.

14 Claims, 8 Drawing Sheets

CONNECTOR FOR STRUCTURAL APPARATUS

BACKGROUND OF THE INVENTION

This invention relates to a connector for a structural apparatus, and more particularly, to a connector for connecting two or more structural elements.

As disclosed in the U.S. Pat. No. 5,575,580, climbing-type playground equipment is generally constructed from a plurality of vertical parts, secured in the ground, to which a series of bars are connected in order to provide a climbing ladder, for example. In order to simplify the construction while providing versatility in use, the connector of the U.S. Pat. No. 5,575,580 was developed. Among the many advantages of such connector includes: (a) a single connector assembly that permits the connection of a plurality of structural members to a vertical post, (b) a connector assembly that permits structural members to be connected at selected positions about the periphery of a vertical post, (c) a connector that permits structural members to be connected to a vertical post at the same height position.

It has now been discovered that several additional advantages can be achieved including: (a) facilitating the assembly of the connector around a vertical post; (b) facilitating the mounting of the connector to the post; (c) increasing the use and durability of the connector; (d) facilitating the assembly of an improved component receiver to the connector and to an elongated cylindrical bar; and (e) providing reduced cost from such changes.

BRIEF SUMMARY OF THE INVENTION

Among the several objects and advantages of the present invention include:

The provision of a new and improved connector for connecting structural elements or bars to a vertical post;

The provision of the aforementioned connector which facilitates the assembly of the connector parts to form a connector assembly for mounting to a vertical post;

The provision of the aforementioned connector which improves the mounting of the individual connector elements to each other and to a vertical post;

The provision of the aforementioned connector which improves the use and durability of the connector when mounted to a vertical post;

The provision of the aforementioned connector which includes an improved component receiver to facilitate assembly to the connector and to an elongated bar;

The provision of the aforementioned connector which further simplifies the connectors, reduces cost, and is otherwise well adapted for the purposes intended.

Briefly stated, the connector for a structural apparatus according to the present invention includes a pair of oppositely disposed C-shaped connectors adapted to surround a post and are detachably connected to one another. The connectors are adapted to be positioned in a first and second movable position. The first movable position allows the connectors to be moved relative to each other as well as to as to the post. The second fixed position is where the connectors are secured to the post. Each C-shaped connector has complementary interfitting end elements for assembling the pair of C-shaped connectors together to surround the post. The C-shaped connectors are secured to each other by complementary fastening elements that extend in the same direction as and cooperate with the complementary interfitting end elements. Each C-shaped connector is secured to the post by an independent fastening element.

The complementary fastening element securing the C-shaped connectors to each other includes a threaded fastener extending through one C-shaped connector for complementary threaded engagement in an opening of the other C-shaped connector.

The complementary interfitting end elements or connections are provided on transversely extending end surfaces at opposite ends of each C-shaped connector for assembling the pair of C-shaped connectors to each other. The complementary fastening elements extend through adjacent end surfaces of the C-shaped connectors for securing the C-shaped connectors to each other.

The complementary interfitting end elements or connections on the end surfaces of the C-shaped connectors include complementary male and female interfitting connections. The complementary fastening elements extending through adjacent end surfaces of the C-shaped connectors are positioned intermediate the complementary male and female interfitting connections.

The complementary fastening elements extending through adjacent end surfaces include a threaded fastener extending through one end surface of one C-shaped connector for complementary threaded engagement in an opening of the opposite end surface of the same C-shaped connector. The opening in the end surface of the other C-shaped connector is tapped with a complementary thread for threadably receiving the threaded fastener extending through the end surface of one C-shaped connector. The threaded fastener that extends through an associated end surface is also provided with an enlarged through opening along an outer peripheral surface of one end surface for insertion of the threaded fastener into the one C-shaped connector and through its opposing end surface.

Each independent fastening element includes a threaded fastener that extends through each C-shaped connector for complementary threaded engagement with the post. The independent fastening element is preferably a self-threading fastener that extends generally transversely through an associated C-shaped connector for securing same to the post.

Each C-shaped connector includes a channel that receives the self-threading fastener. Marginal areas surrounding each channel member are adapted to engage the outer surface of the post in order to prevent rusting or deterioration of the component parts of the connector.

The connector further includes at least one component receiver slidably mounted on one of the C-shaped connectors, the component receiver also capable of being secured to the one C-shaped connector in any desired position. The component receiver also supports another element relative to the post.

The component receiver is preferably formed into identical mirror image half sections to facilitate assembly to an elongated bar as well as to the connector.

These and other objects and advantages of the present invention will become apparent from the description that follows.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

Figure 1:
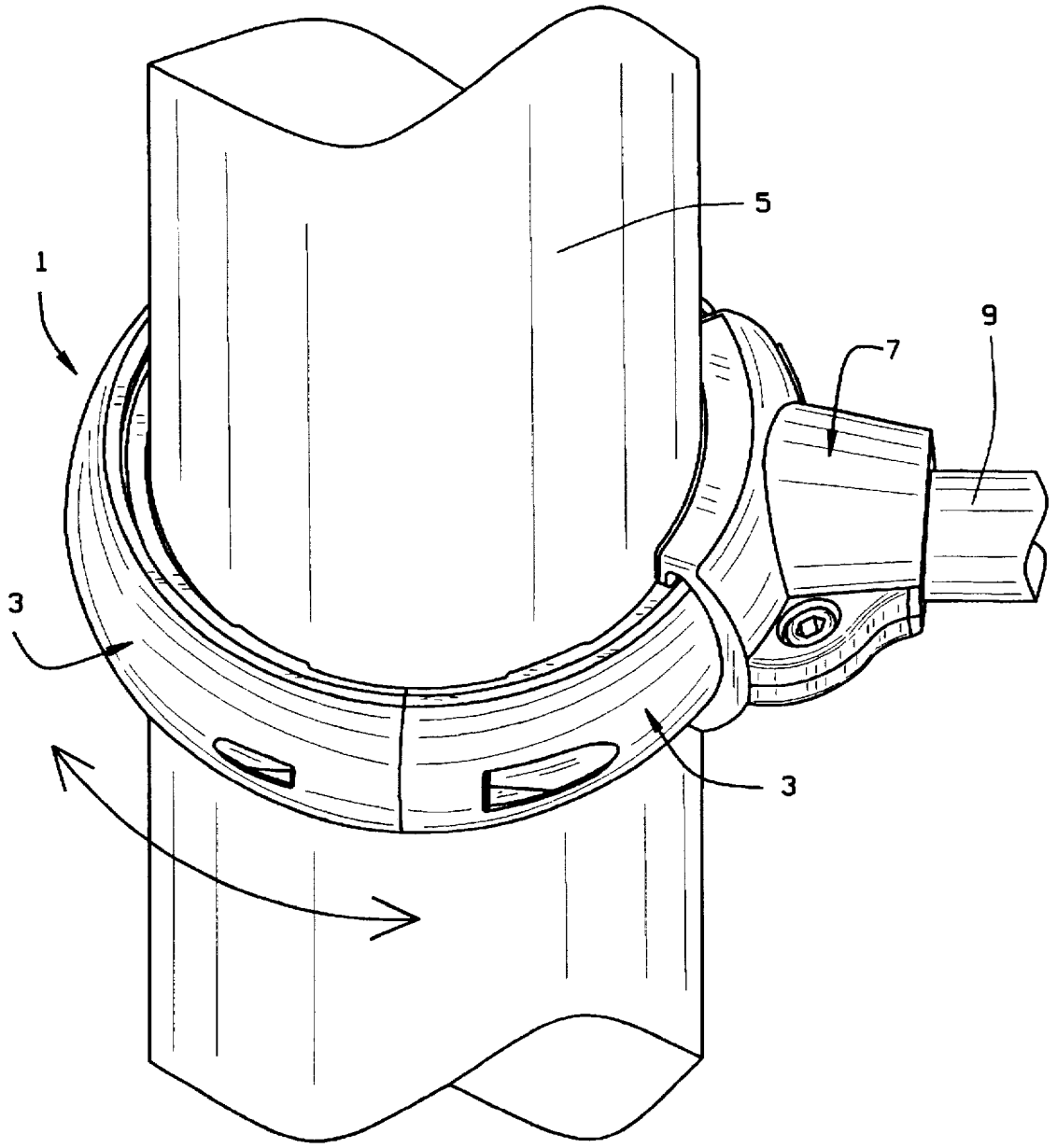
FIG. 1 is a perspective view illustrating the various components of the connector of the present invention together with a preferred component receiver.
Figure 2:
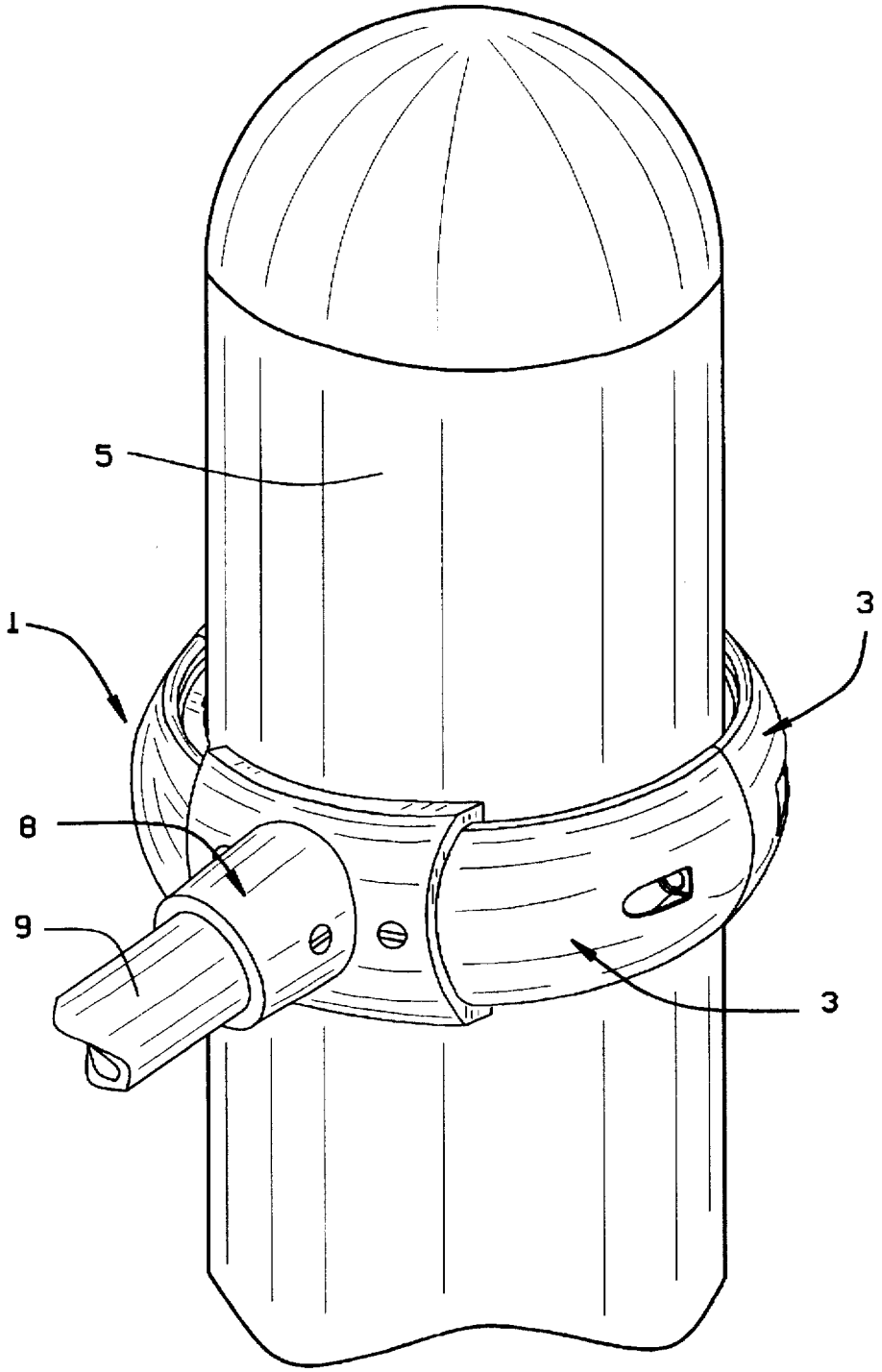
FIG. 2 is a perspective view of the connector secured around a vertical post with a different type of component receiver.

The connector 1 for structural apparatus is illustrated in FIGS. 1–2 as including a pair of oppositely disposed C-shaped connectors 3, 3 which are detachably connected to one another and are adapted to surround a vertical post 5 at a preselected height. The pair of oppositely disposed C-shaped connectors 3, 3 are positioned in a movable position and a fixed position. The movable position allows the C-shaped connectors 3, 3 to be moved relative to each other as well as to the vertical post 5. The fixed position is where the C-shaped connectors 3, 3 are secured to the vertical post 1.

FIG. 1 further illustrates a preferred type of component receiver 7 that is adapted to be mounted on one of the C-shaped connectors 3 for supporting an elongated cylindrical bar 9. As will be appreciated, in order to provide a climbing unit, a pair of vertical posts each having C-shaped connectors 3, 3 with a component receiver 7 are required for supporting a single elongated cylindrical bar 7. This provides a climbing step that can be duplicated in the same manner so as to provide a series of climbing steps for a climbing ladder used in playground equipment.

Figure 7:
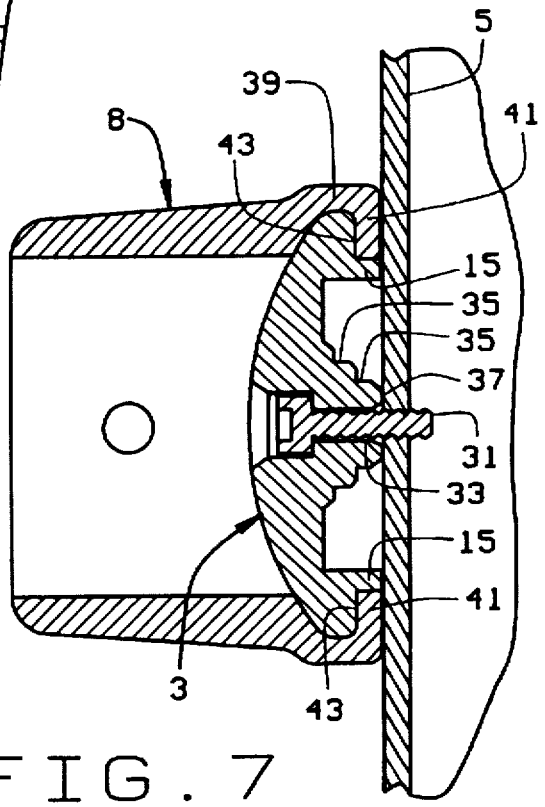
FIG. 7 is a cross sectional view of the connector as viewed along lines 4—4 of FIG. 2.
Figure 8:
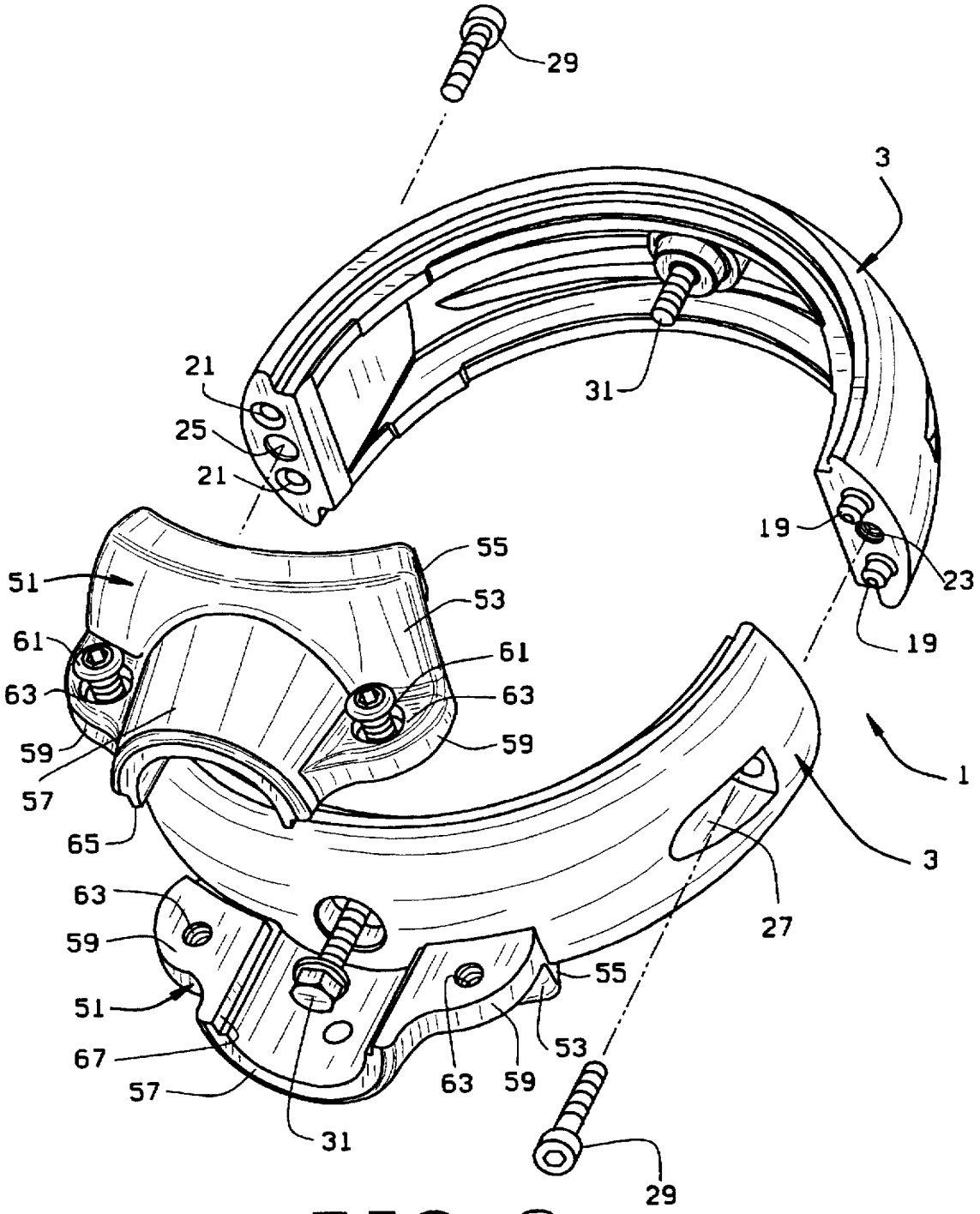
FIG. 8 is an exploded perspective view of the two C-shaped connectors together with the preferred component receiver of the present invention.
Figure 9:
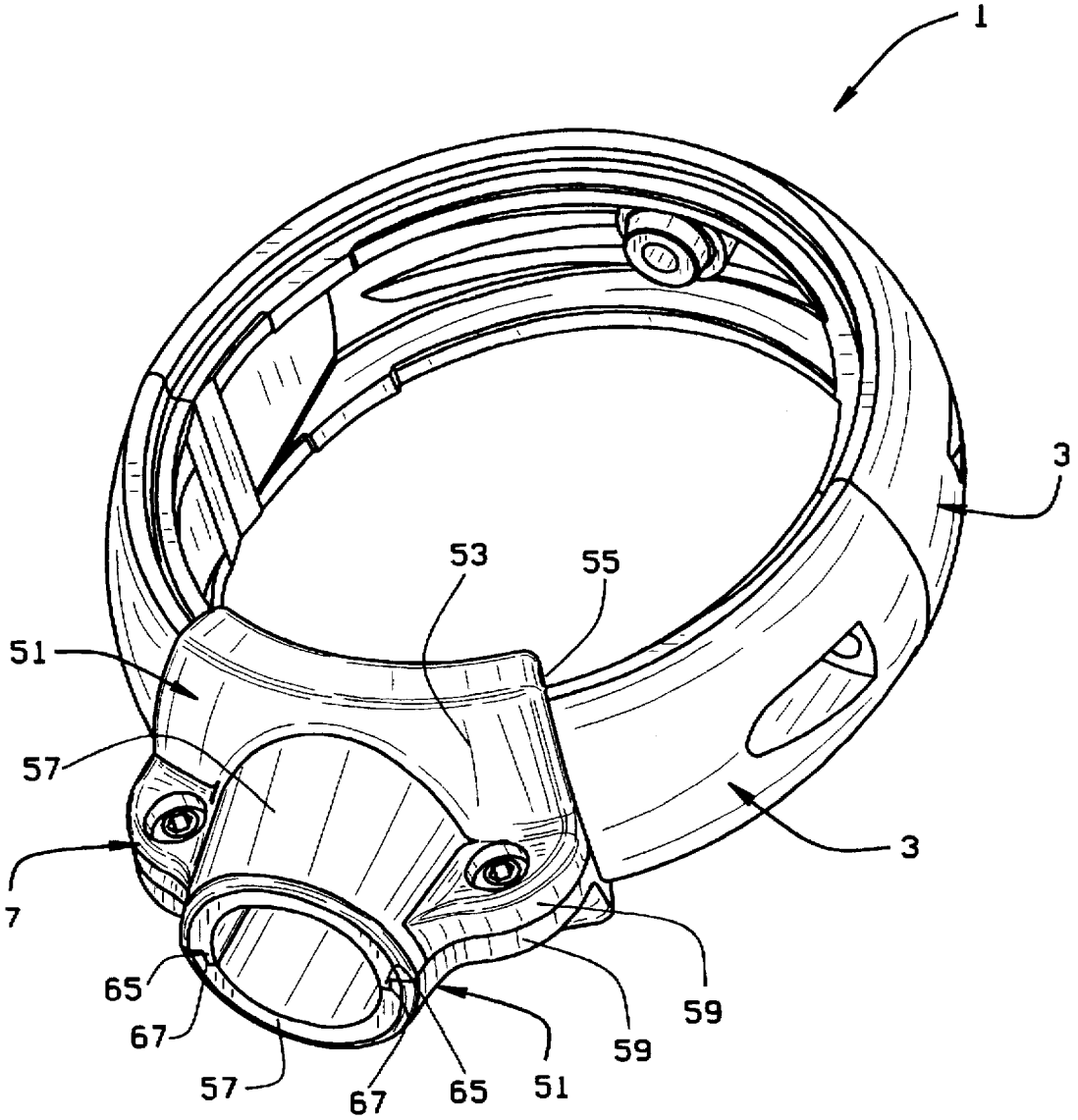
FIG. 9 is a perspective view of the two C-shaped connectors and preferred component receiver shown assembled to one another.

FIGS. 8–9 further illustrate the construction of the preferred component receiver 7 as discussed below. FIGS. 2–3, 5 and 7 illustrate a different type of component receiver 8 as will also be discussed below.

In order to understand the specific structure of the connectors 3, 3, reference is made to FIGS. 3–7 of the drawings. As will be appreciated, each of the C-shaped connectors 3, 3 are identically constructed, and therefore, reference to one of the C-shaped connectors will be understood as applying to the other C-shaped connector 3.

Figure 3:
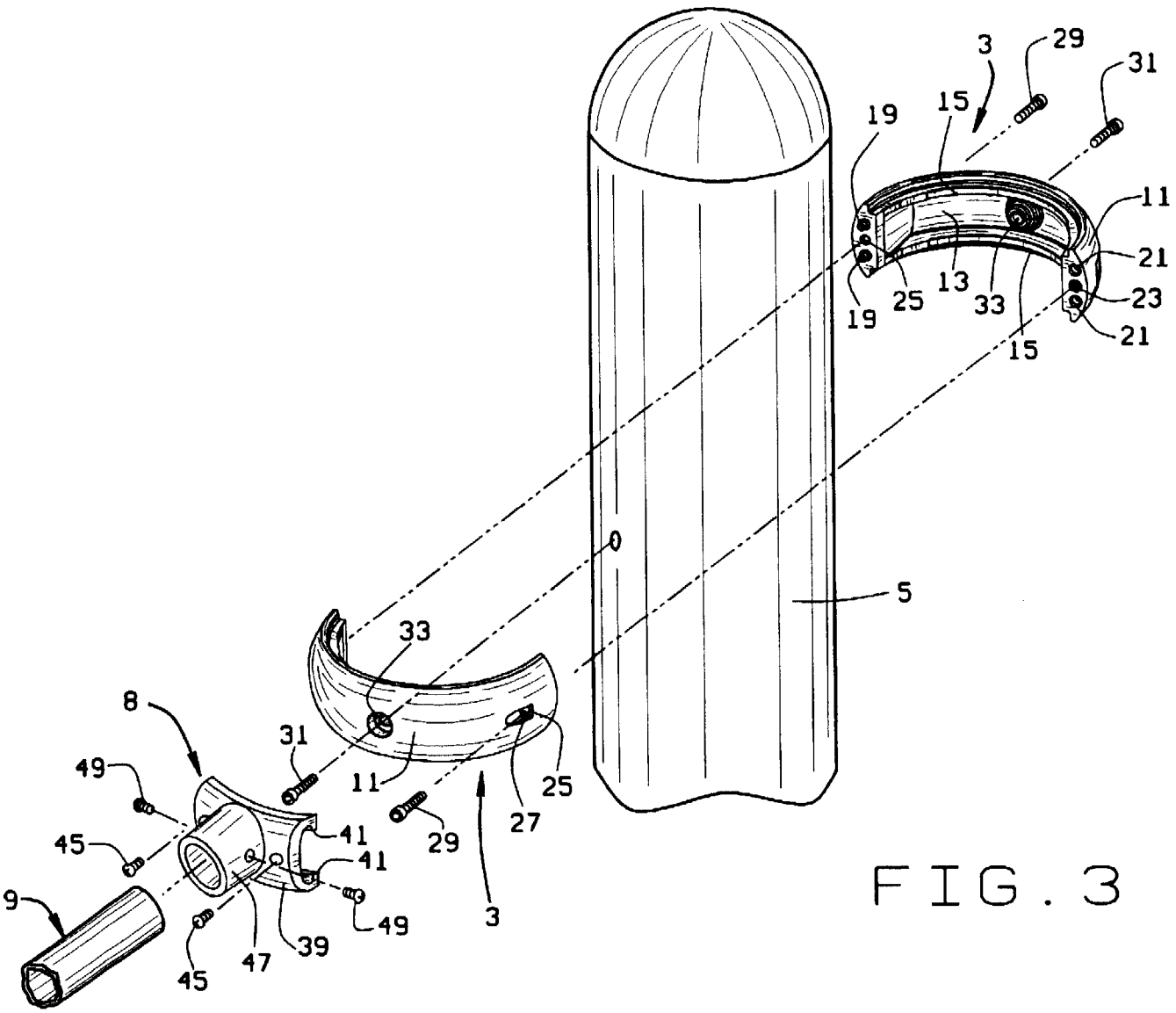
FIG. 3 is an exploded perspective view of the connector and the vertical post to which the connector is secured.
Figure 4:
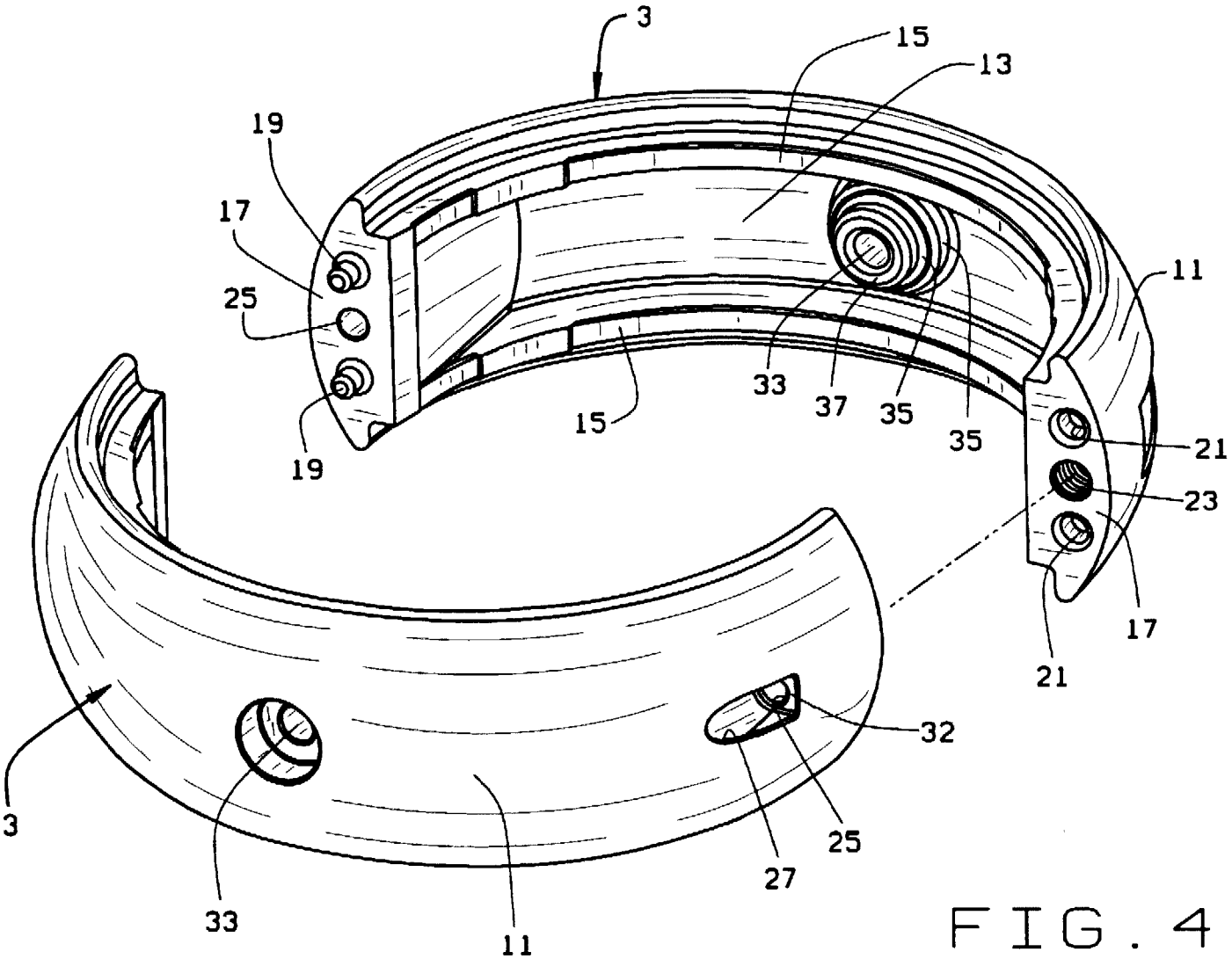
FIG. 4 is an exploded perspective view of the two C-shaped connectors forming the connector of the present invention.
Figure 5:
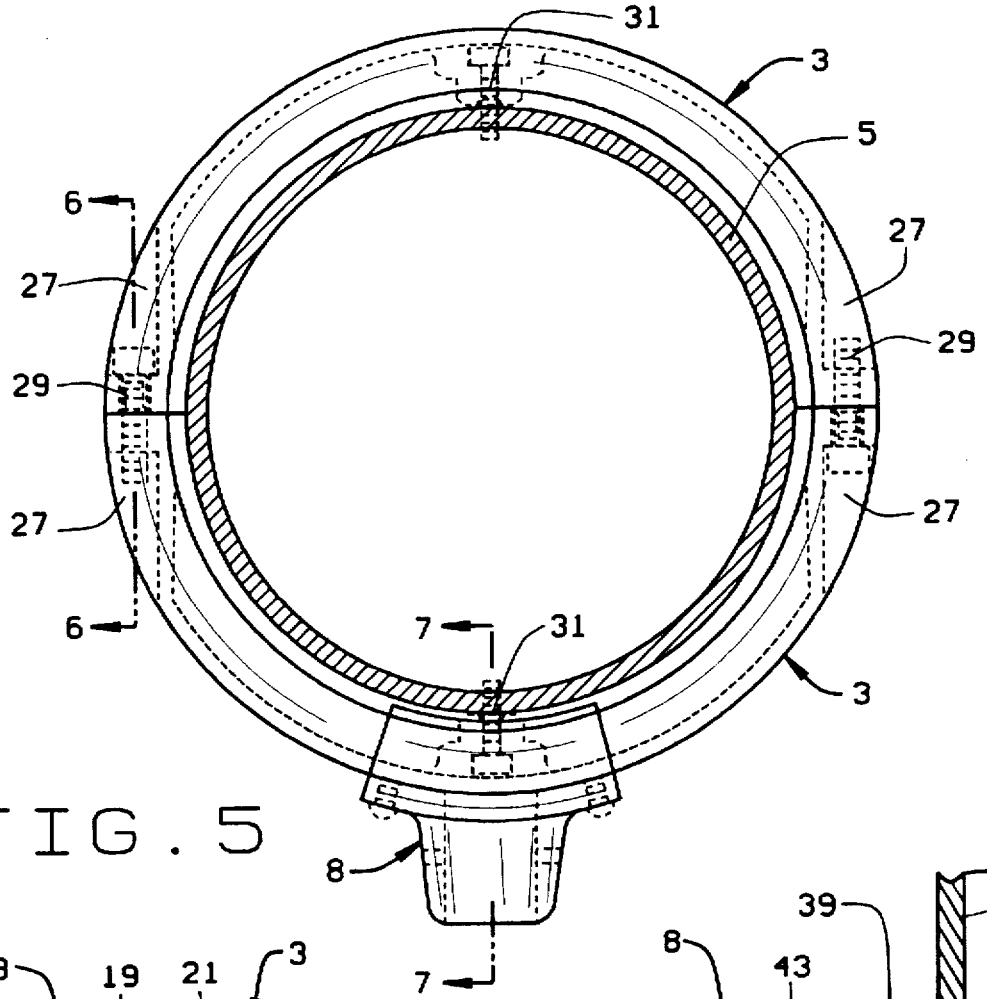
FIG. 5 is a top plan view, partially in section, of the connector when assembled to a vertical post.

The exploded perspective views of FIGS. 3–4 illustrate each C-shaped connector 3 as having an outer arcuately-shaped surface 11 and an inner indented surface or channel 13 defined by a pair of oppositely disposed, spaced apart arcuate projections 15, 15. Each C-shaped connector terminates at opposite ends in generally transversely extending end surfaces 17, 17. One of the transversely extending end surfaces 17 has a pair of spaced male connections 19, 19 which interfit within complementary female interfitting connections 21, 21 provided on a transversely extending end surface 17 of on the other C-shaped connector.

Figure 6:
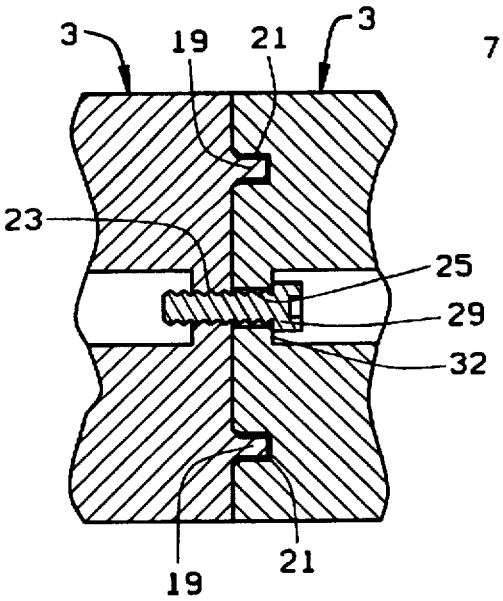
FIG. 6 is a cross sectional view of the connector as viewed along lines 3—3 of FIG. 2.

The manner in which complementary male and female interfitting connections 19, 21 structurally cooperate with one another is best illustrated in FIG. 6 of the drawings. Between the spaced male interfitting connections 19, 19 is an opening or hole 23. Similarly, between the female interfitting connections 21, 21 is an opening or hole 23. Each C-shaped connector 3 has an opening or hole 25 that is aligned with one of the openings or holes 23 in the other C-shaped connectors 3, the opening or hole 25 itself opening up into the outer arcuate surface 11 through the U-shaped opening 27. A threaded fastener 29 (FIG. 6) extends through the opening 25 and rests on the shoulder 32 surrounding the opening 25, while being driven threaded engagement with the hole 23 in the other C-shaped connector 3. As best seen in FIG. 3 of the drawings, there are two threaded fasteners 29, 29 which freely extend through corresponding openings 25, 25 in one of the C-shaped connectors 3 for threaded engagement with the tapped holes 23, 23 in the other C-shaped connector 3. In this manner, the oppositely disposed C-shaped connectors 3, 3 are detachably connected to one another by the threaded fastener 29,29 which extend in the same direction as and cooperate with the complementary interfitting male and female elements 19, 19 and 21, 21 on the oppositely disposed C-shaped connectors 3,3.

In order to secure each of the C-shaped connectors 3 to the vertical post 5, a self-threading fastener 31 extends through an opening 33 in each C-shaped connector 3, 3 for self-threading engagement with the vertical post 5. It will be noted that the opening 33 is defined by a series of formed circular steps 35 that decrease from the outer arcuate surface 11 towards the inner channel or groove 13 of each C-shaped connector 3. The innermost end 37 of the circular steps 35, surrounding the opening 33, is arranged to engage the outer surface of the vertical post 5 when the self-threading fastener 31 secures each connector 3 to the post 5. As a result, any metal filings that result from the self-threading operation will be trapped within the opening 33 so as to prevent rust or other deterioration of the post 5, U-shaped connector 3 or any of the other components. This is best illustrated in FIG. 7 of the drawings where the outermost shoulder 37 is illustrated as being in direct contacting engagement with the vertical post 5.

The construction of the C-shaped connectors 3, 3 and the manner in which the same are secured to the vertical post 5 enables the C-shaped connectors 3, 3 to be selectively positioned at a variety of locations along the vertical post 5, while at the same time being quickly and easily secured to the vertical post 5, as may be desired.

In order to mount cylindrical bars 9 to the connectors 3, 3, a component receiver 7, as shown in FIGS. 1 and 8–9, or a component receiver 8, as shown in FIGS. 2–3 and 5–7 is required. Referring first to the component receiver 8 shown in FIGS. 2–3 and 5–7, it will be seen that the component receiver 8 includes a channel shaped section 39 having opposed shoulders 41, 41 that are adapted to be received within upper and lower grooves or channels 43, 43 at opposite ends of each C-shaped connector 3. Suitable set screws 45, 45 extend through the channel shaped section 39 of the component receiver 8 in order to secure the component receiver 8 to one of the C-shaped connectors at the desired location, as shown in FIG. 3. Component receiver 8 further includes a cylindrical hollow stub shaft 47 for receiving the elongated cylindrical bar 9. Set screws 49, 49 extend through suitable openings of the hollow stub shaft 47 in order to secure the elongated cylindrical bar 9 within the hollow cylindrical stub 47, as shown in FIG. 3. As a result, a plurality of elongated cylindrical bars 9 can be received in opposed component receivers 8 mounted on one of the C-shaped connectors 3 that is secured to spaced vertical posts 5 in order to provide a plurality of climbing rungs or steps for a climbing ladder unit.

Referring now to the preferred form of component receiver 7 shown in FIGS. 1 and 8–9, it will be seen that the component receiver 7 is formed from two identical mirror image component receiver halves 51, 51. Specifically, each component receiver half 51 includes a half channel shaped section 53 having a shoulder 55 at an outermost end. The shoulder 55, corresponds to the shoulder 41 in the component receiver 8 and is adapted to be received within upper or lower grooves or channels 43 at opposite ends of each C-shaped connector. A semi-cylindrically or channel shaped section 57 extends outwardly from each component receiver half 51 with opposed flanges 59, 59 on each side of the semi-cylindrically shaped section 57. As illustrated in FIGS. 8–9 of the drawings, the component receiver half sections 51, 51 are adapted to be mated in identical mirror image relationship with a screw 61 extending through a hole 63 in each of the opposed flanges 59 that are arranged in mirror image relationship to each other for complementary threaded engagement. To assist in aligning the semi-cylindrical sections 57, 57 relative to each other, complementary male and female interfitting connections 65, 67, respectively, are provided on each side of the opposing semi-cylindrical sections 57, 57.

As will be appreciated, the construction of the semi-cylindrical half sections 57, 57 of the component receiver 7 will facilitate the assembly and mounting of the elongated cylindrical bar 9 to the component receiver 7 since the semi-cylindrical half sections 57, 57 can be easily assembled relative to one another as discussed above, once the elongated cylindrical bar 9 is placed in position between the semi-cylindrical half sections 57, 57 of the component receiver 7.

Figure 10:
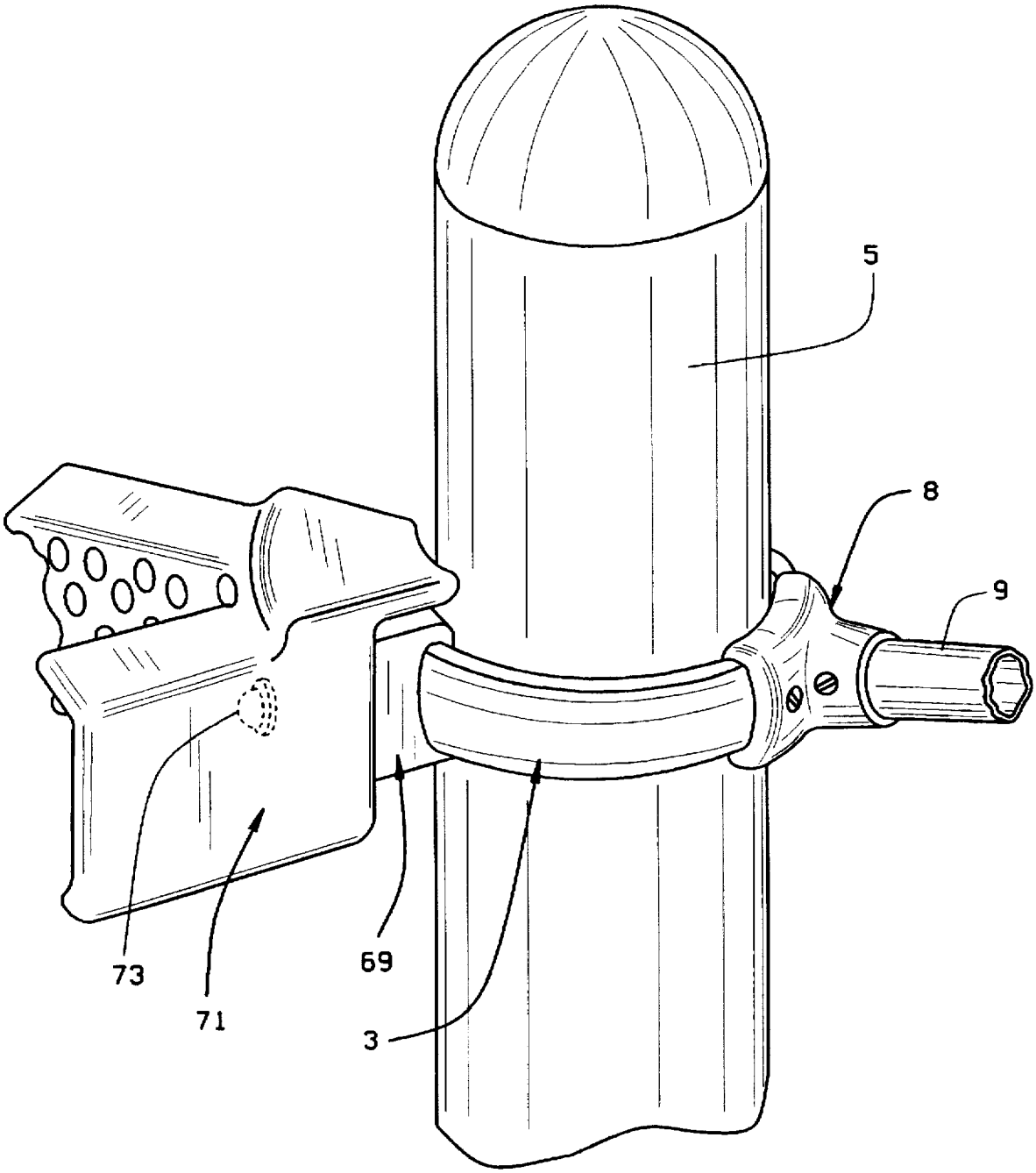
FIG. 10 is a perspective view illustrating the connector assembled to the vertical post with two different structural elements mounted to various component receivers that are mounted on the C-shaped connectors.

In addition to receiving an elongated cylindrical bar 9, the component receiver 69 may be modified as shown in FIG. 10 of the drawings for connecting a foothold 71 through one or more fasteners 73. Thus, the component receiver 7, 8 and/or 51 may be used to secure a variety of different components to the C-shaped connectors 3, 3 in order to provide the desired playground climbing unit.

From the foregoing, it will now be appreciated that the present invention provides connectors for a structural assembly that connects two or more structural members to each other. The oppositely disposed C-shaped connectors of the present invention provides an easily assembled, readily adjustable construction that permits one or more structural members to be connected to the assembly. The present invention further permits the selected positioning of a number of different structural members about the periphery of the vertical post as well as along the height of the vertical post, in order to provide the desired playground equipment climbing unit. As a result, the improved connector construction of the present invention provides a easily assembled, cost competitive and long lasting connector assembly that achieves the objects and advantages of the present invention.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A connector for structural apparatus in which the connector is adapted to be secured to a post and comprising:

a pair of oppositely disposed C-shaped connectors adapted to surround a post and being detachably connected to one another, said connectors being positioned in a first movable position allowing movement of the connectors relative to each other as well as to the post and a second fixed position where the connectors are adapted to be secured to the post;

each C-shaped connector having complementary interfitting end elements for assembling the pair of C-shaped connectors together to surround the post;

the C-shaped connectors being secured to each other by complementary first fastening elements that extend in the same direction as and cooperate with the complementary interfitting end elements; and each of the C-shaped connectors adapted to be secured to the post by a second self-threading fastening element independent of the first fastening element, each second self-threading fastening element received in a through channel of each C-shaped connector that extends between each C-shaped connector and the post, and each through channel having an adjacent series of surrounding stepped surfaces adapted to trap metal filings resulting from the threading of the second self-threading fastening elements.

2. The connector as defined in claim 1 in which the complementary fastening elements securing the C-shaped connectors to each other includes a threaded fastener extending through one C-shaped connector for complementary threaded engagement in an opening of the other C-shaped connector.

3. The connector as defined in claim 1 and further including a component receiver slidably mounted on one of the C-shaped connectors, the component receiver being formed into component receiver half sections having complementary semi-cylindrical sections for receiving an elongated cylindrical bar.

4. A connector for structural apparatus in which the connector is adapted to be secured to a post and comprising:

a pair of oppositely disposed C-shaped connectors adapted to surround a post and being detachably connected to one another, said connectors being positioned in a first movable position allowing movement of the connectors relative to each other as well as to the post and a second fixed position where the connectors are secured to the post;

each C-shaped connector terminating in generally transversely extending end surfaces;

complementary interfitting connections provided on each end surface for assembling the pair of C-shaped connectors to each other;

complementary first fastening elements extending through adjacent end surfaces of the C-shaped connectors for securing the C-shaped connectors to each other; and a second independent self-threading fastening element extending through each C-shaped connector adapted for securing each C-shaped connector to the post, each second independent self-threading fastening element positioned in a through channel in each C-shaped connector that extends between each C-shaped connector and the post, and each through channel having an adjacent series of surrounding stepped surfaces adapted to trap metal filings resulting from the threading of the second self-threading fastening elements.

5. The connector as defined in claim 4 in which the complementary interfitting connections on the end surfaces of C-shaped connectors include complementary male and female interfitting connections.

6. The connector as defined in claim 5 in which the complementary fastening elements also extending through adjacent end surfaces of the C-shaped connectors are positioned intermediate the complementary male and female interfitting connections.

7. The connector as defined in claim 6 in which the complementary fastening elements also extending through adjacent end surfaces include a threaded fastener extending through the end surface of one C-shaped connector for complementary threaded engagement in an opening of the end surface of the other C-shaped connector.

8. The connector as defined in claim 7 in which the opening in the end surface of the other C-shaped connector is tapped with a complementary thread for threadably receiving the threaded fastener extending through the end surface of one C-shaped connector.

9. The connector as defined in claim 8 in which the one C-shaped connector that includes the threaded fastener extending through its associated end surface is also provided with an enlarged through opening along an outer peripheral surface of the one C-shaped connector for insertion of the threaded fastener into the one C-shaped connector and through its associated end surface.

10. The connector as defined in claim 8 in which each independent fastening element is a self-threading fastener that extends generally transversely through an associated C-shaped connector for securing same to the post.

11. The connector as defined in claim 10 and including marginal areas surrounding each channel adapted to engage the post to trap metal filings resulting from the self-threading operation.

12. The connector as defined in claim 4 in which the structural apparatus includes a component receiver slidably mounted on one of the C-shaped connectors, said component receiver capable of being secured to the one C-shaped connector in a desired position, and the component receiver also also adapted to support another element as part of the structural apparatus relative to the post.

13. The connector as defined in claim 4 in which the structural apparatus includes a component receiver slidably mounted on one of the C-shaped connectors, the component receiver being formed into component receiver half sections having complementary semi-cylindrical sections adapted for receiving an elongated cylindrical bar.

14. The connector as defined in claim 13 in which the component receiver half sections are:

mirror image component receiver half sections each having a shoulder for engaging upper and lower channels of the connector; the mirror image component receiver half sections having complementary mirror image channel shaped sections adapted for surrounding an elongated bar on opposite sides and flange elements provided on the mirror image component receiver half sections for receiving fasteners to assemble the mirror image component receiver half sections to the connector and to an elongated bar.

* * * * *